US006590482B2

(12) United States Patent
Castonguay et al.

(10) Patent No.: US 6,590,482 B2
(45) Date of Patent: Jul. 8, 2003

(54) CIRCUIT BREAKER MECHANISM TRIPPING CAM

(75) Inventors: Roger N. Castonguay, Terryville, CT (US); Dave Christensen, Harwinton, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,197

(22) Filed: Aug. 3, 2001

(65) Prior Publication Data

US 2002/0000903 A1 Jan. 3, 2002

Related U.S. Application Data

(60) Division of application No. 09/615,970, filed on Jul. 14, 2000, which is a continuation-in-part of application No. 09/516,475, filed on Mar. 1, 2000.

(60) Provisional application No. 60/190,180, filed on Mar. 17, 2000.

(51) Int. Cl.[7] ..... H01H 9/00

(52) U.S. Cl. ..... 335/172; 335/174

(58) Field of Search ..... 335/23–35, 167–176

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,105,048 | A | 9/1963 | Bobrowsky |
| 3,155,802 | A | 11/1964 | Wortmann |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |

(List continued on next page.)

*Primary Examiner*—Lincoln Donovan
(74) *Attorney, Agent, or Firm*—Cantor Colburn LLP

(57) ABSTRACT

A circuit breaker operating mechanism for separating a pair of electrical contacts within an electrical circuit breaker includes a lower link operatively connected to one of the electrical contacts. An upper link includes first and second legs extending from a central portion. The first leg is pivotally secured to the lower link, and the second leg includes a cam surface formed thereon. A roller is in intimate contact with the cam surface, and the cam surface is configured such that movement of the upper link relative to the roller causes the upper link to pivot about the central portion. Pivoting of the upper link about the central portion moves the lower link causing the second contact to move away from the first contact. An operating spring is configured to provide a force for separating the electrical contacts when the operating mechanism is tripped. An operating handle includes a void disposed therein, and an end of the spring is secured to the operating handle within the void.

5 Claims, 13 Drawing Sheets

U.S. PATENT DOCUMENTS

| | | | | |
|---|---|---|---|---|
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,713,639 | A | * | 12/1987 | Grunert et al. ..... 335/59 |
| 4,717,985 | A | | 1/1988 | Demeyer |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,935,712 | A | | 6/1990 | Oyama et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | * | 3/1994 | Crookston et al. ..... 335/172 |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,504,284 | A | | 4/1996 | Lazareth et al. |
| 5,504,290 | A | | 4/1996 | Baginski et al. |
| 5,510,761 | A | | 4/1996 | Boder et al. |
| 5,512,720 | A | | 4/1996 | Coudert et al. |
| 5,515,018 | A | | 5/1996 | DiMarco et al. |
| 5,519,561 | A | | 5/1996 | Mrenna et al. |
| 5,534,674 | A | | 7/1996 | Steffens |
| 5,534,832 | A | | 7/1996 | Duchemin et al. |

| | | | |
|---|---|---|---|
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |

FOREIGN PATENT DOCUMENTS

| | | | |
|---|---|---|---|
| DE | 38 02 184 | | 8/1989 |
| DE | 38 43 277 | | 6/1990 |
| DE | 44 19 240 | | 1/1995 |
| EP | 0 061 092 | | 9/1982 |
| EP | 0 064 906 | | 11/1982 |
| EP | 0 066 486 | | 12/1982 |
| EP | 0 076 719 | | 4/1983 |
| EP | 0 117 094 | | 8/1984 |
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 0 555 158 | | 8/1993 |
| EP | 0 555 158 | A | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 700 140 | | 3/1996 |
| EP | 0 889 498 | | 1/1999 |
| FR | 2 171 863 | A | 9/1973 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | A | 4/1993 |
| FR | 2 682 531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| WO | 92/00598 | | 1/1992 |
| WO | 92/05649 | | 4/1992 |
| WO | 94/00901 | | 1/1994 |

* cited by examiner

CIRCUIT BREAKER MECHANISM TRIPPING CAM

CROSS REFERENCE TO RELATED APPLICATIONS

This application is a divisional of U.S. patent application Ser. No. 09/615,970 entitled "Circuit Breaker Mechanism Tripping Cam", filed Jul. 14, 2000, which is a continuation-in-part of U.S. patent application Ser. No. 09/516,475 entitled "Circuit Interrupter Operating Mechanism", filed on Mar. 1, 2000, which is incorporated by reference herein in its entirety. This application also claims the benefit of U.S. Provisional Patent Application No. 60/190,180 filed on Mar. 17, 2000 which is incorporated by reference herein in its entirety.

BACKGROUND OF INVENTION

The present invention is directed to circuit interrupters, and more particularly to circuit interrupter operating mechanisms.

Circuit interrupter operating mechanisms are used to manually control the opening and closing of movable contact structures within circuit interrupters. Additionally, these operating mechanisms in response to a trip signal, for example, from an actuator device, will rapidly open the movable contact structure and interrupt the circuit. To transfer the forces (e.g., to manually control the contact structure or to rapidly trip the structure with an actuator), operating mechanisms employ powerful operating springs and linkage arrangements. The spring energy provided by the operating springs must provide a high output force to the separable contacts.

Commonly, multiple contacts, each disposed within a cassette, are arranged within a circuit breaker system for protection of individual phases of current. The operating mechanism is positioned over one of the cassettes and generally connected to all of the cassettes in the system. Because of the close position between each of the cassettes, and between each cassette and the operating mechanism, the space available for movable components is minimal. A typical problem is not having sufficient space to accommodate proper operating springs to generate sufficient energy to rapidly open the breaker contacts when the operating mechanism is tripped. Circuit breakers of the prior art have addressed this problem by increasing the size of the breaker to allow for a larger operating mechanism.

SUMMARY OF INVENTION

In an embodiment of the present invention, a circuit breaker operating mechanism for separating a pair of electrical contacts within an electrical circuit breaker includes a lower link operatively connected to one of the electrical contacts. The operating mechanism further includes an upper link having first and second legs extending from a central portion. The first leg is pivotally secured to the lower link, and the second leg includes a cam surface formed thereon. A roller is in intimate contact with the cam surface, and the cam surface is configured such that movement of the upper link relative to the roller causes the upper link to pivot about the central portion. Pivoting of the upper link about the central portion moves the lower link causing the second contact to move away from the first contact.

In an alternative embodiment of the present invention, a circuit breaker operating mechanism for separating a pair of electrical contacts within an electrical circuit breaker includes an operating spring configured to provide a force for separating the electrical contacts when the operating mechanism is tripped. The operating mechanism further includes an operating handle configured to reset the operating mechanism after the operating mechanism has been tripped. The operating handle includes a void disposed therein, and an end of the spring is secured to the operating handle within the void.

DETAILED DESCRIPTION

Figure 1:
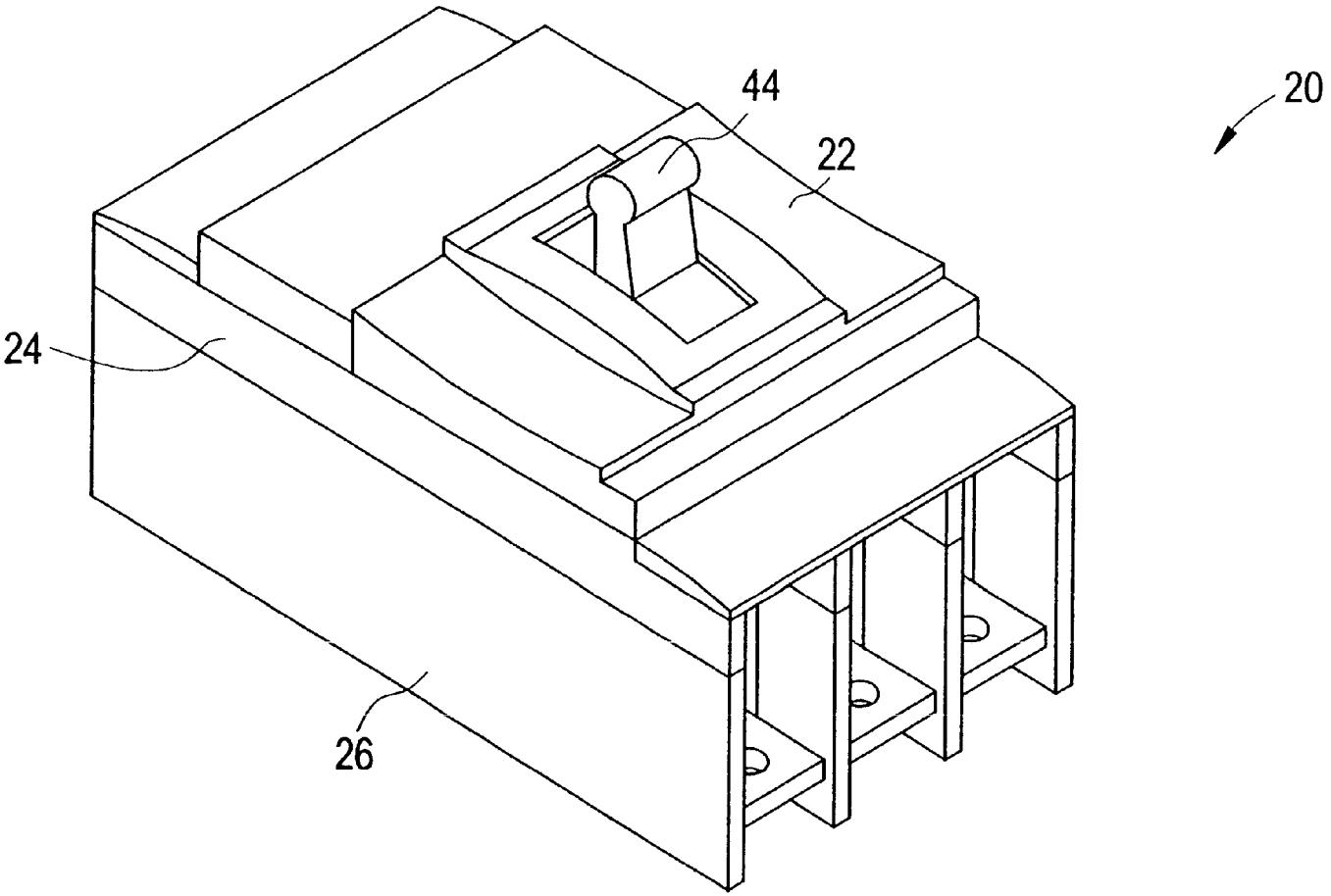
FIG. 1 is an isometric view of a molded case circuit breaker employing an operating mechanism embodied by the present invention.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36. Examples of rotary contact structures that may be operated by operating mechanism 38 are described in more detail in U.S. patent application Ser. No. 09/087,038 and Ser. No. 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

A toggle handle 44 extends through openings 28 and 30 and allows for external operation of cassettes 32, 34 and 36. Examples of rotary contact structures that may be operated by operating mechanism 38 are described in more detail in U.S. patent application Ser. No. 09/087,038 and Ser. No. 09/384,908, both entitled "Rotary Contact Assembly For High-Ampere Rated Circuit Breakers", and U.S. patent application Ser. No. 09/384,495, Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
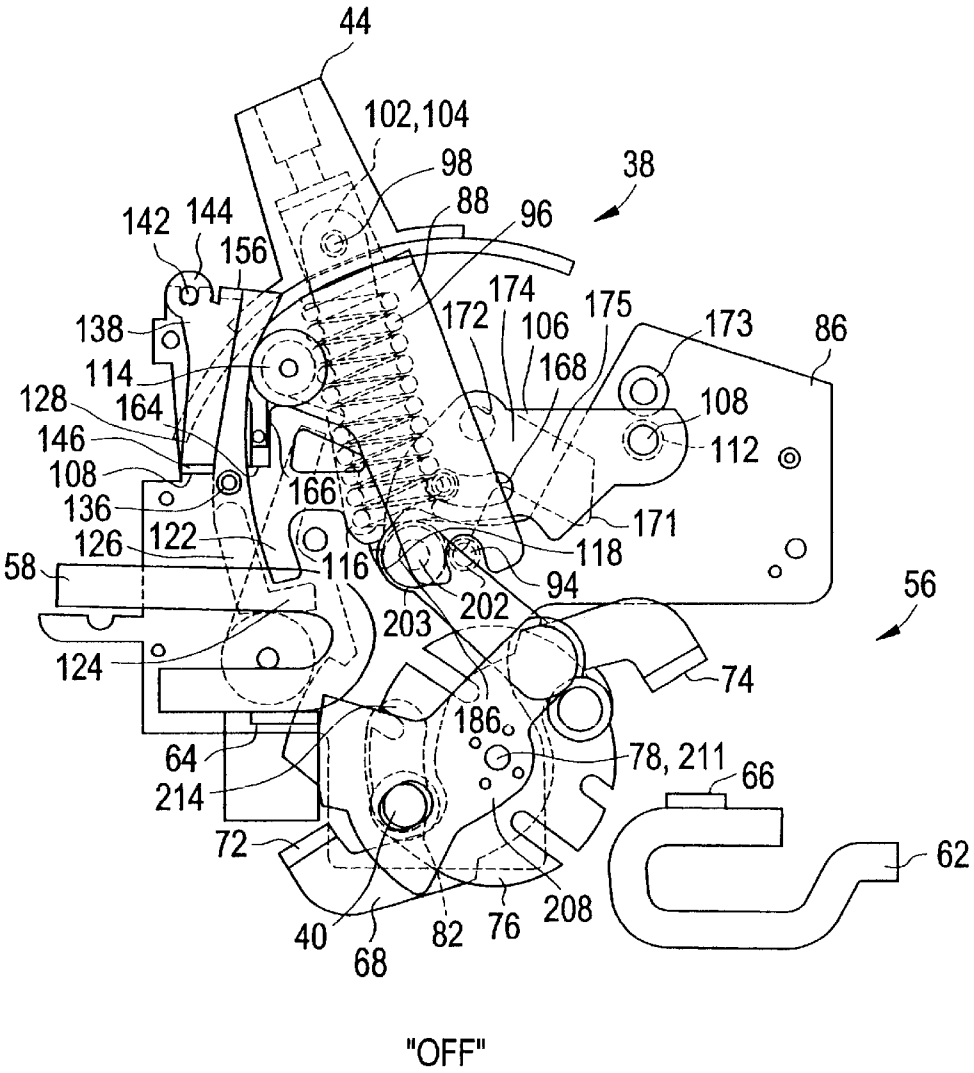
FIG. 3 is a partial sectional view of a rotary contact structure and operating mechanism embodied by the present invention in the "off" position.
Figure 4:
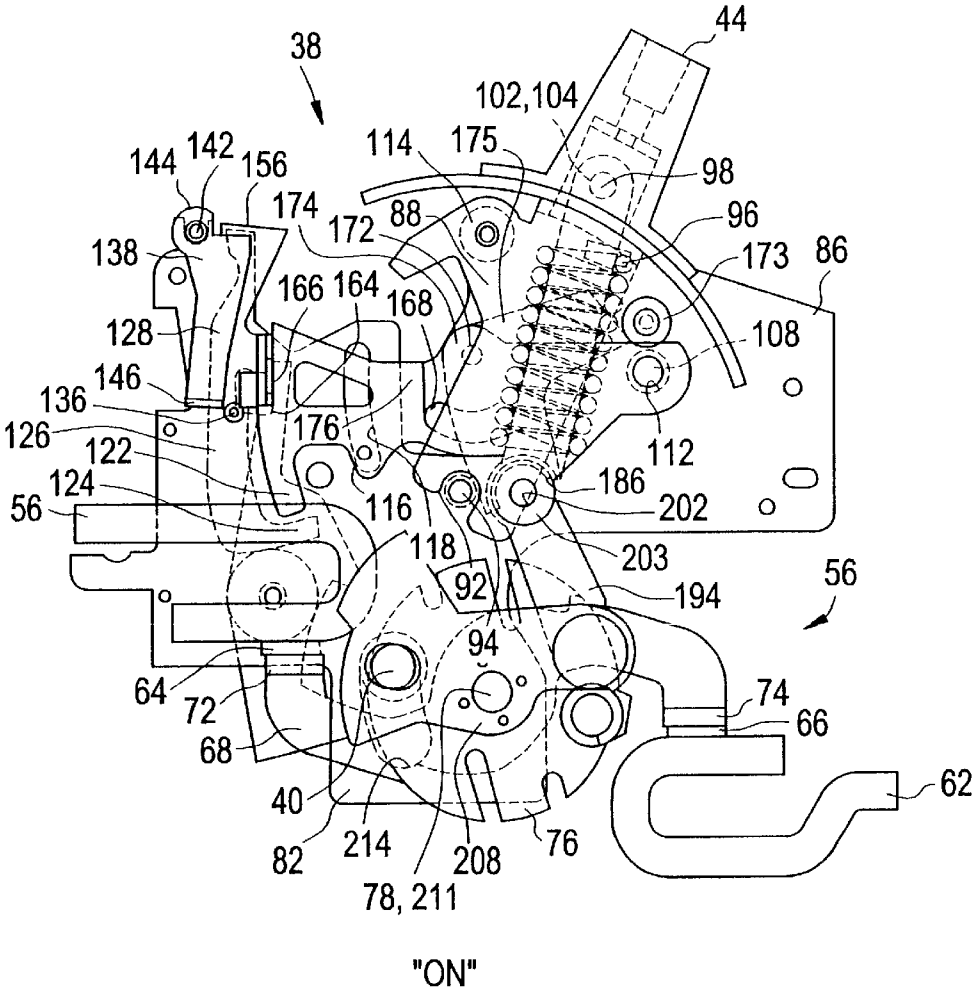
FIG. 4 is a partial sectional view of the rotary contact structure and operating mechanism of FIG. 3 in the "on" position.
Figure 5:
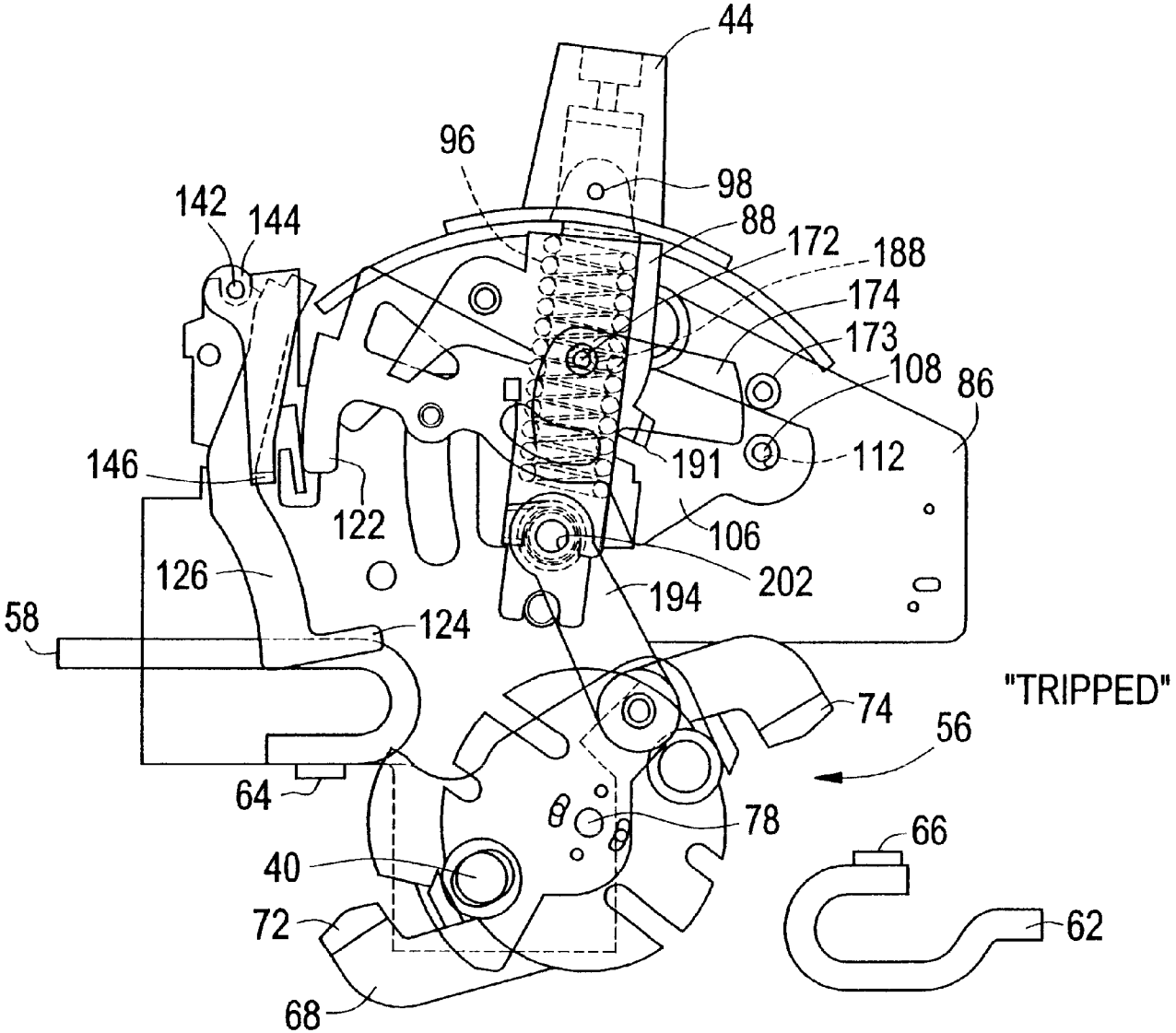
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and a line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 3) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein toggle handle 44 is oriented to the right as depicted in FIG. 3 (e.g., via a manual or mechanical force), contacts 72 and 74 are mated with stationary contacts 64 and 66, there by allowing current to flow through contact arm 68. In the "tripped" position (FIG. 5) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off"position in FIG. 3), and then back to the "on"position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 2:
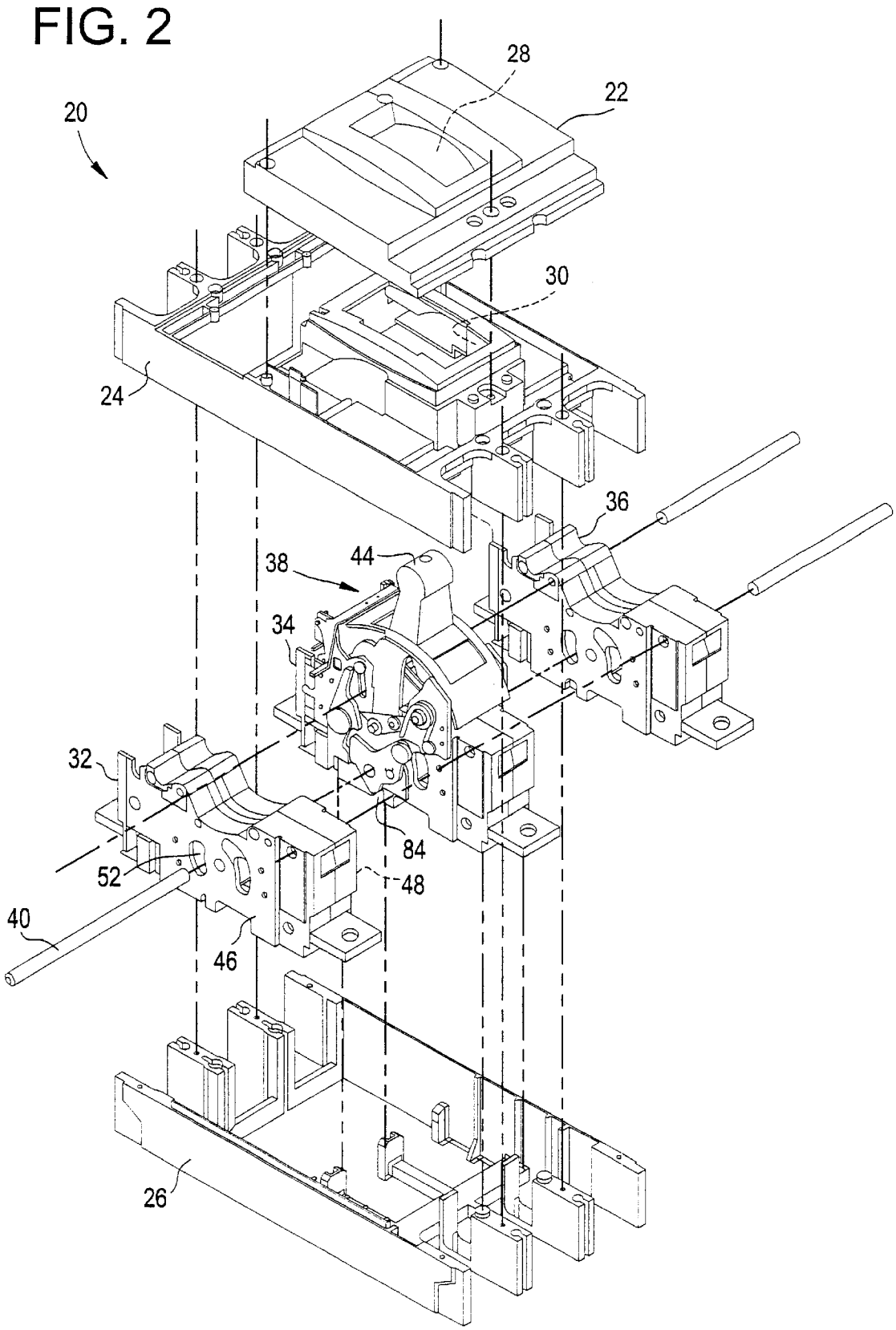
FIG. 2 is an exploded view of the circuit breaker of FIG. 1.
Figure 6:
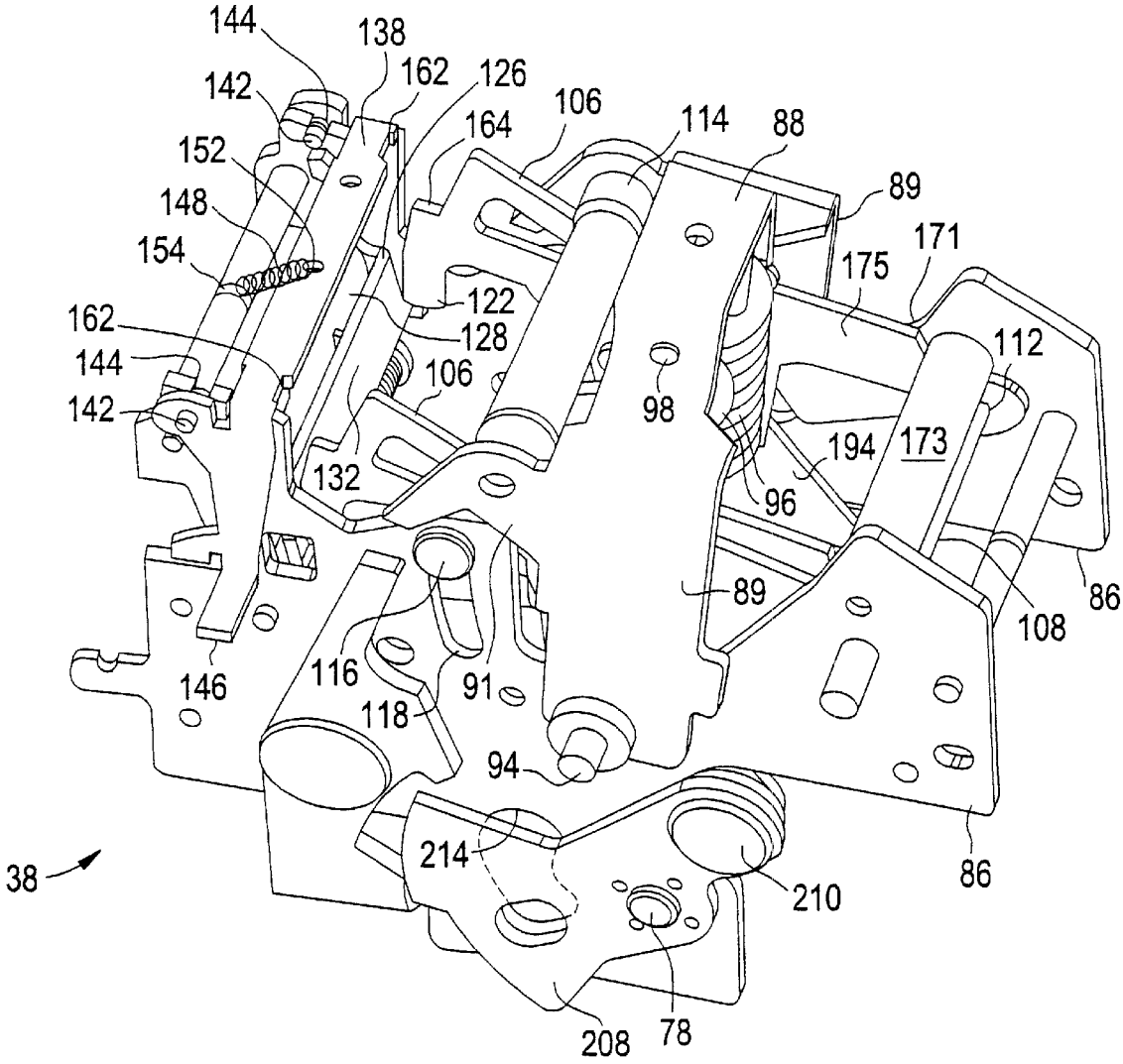
FIG. 6 is an isometric view of the operating mechanism.
Figure 7:
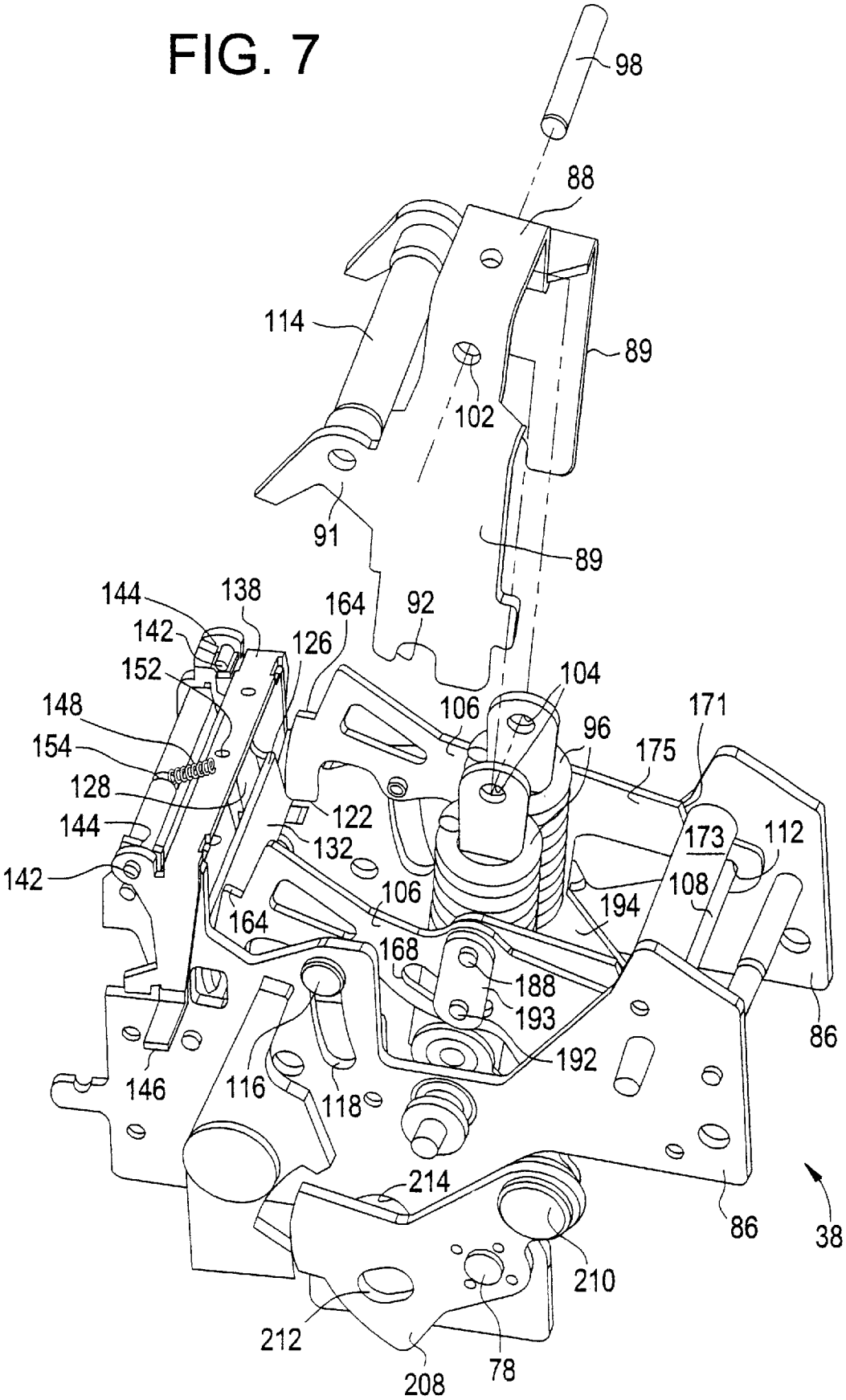
FIG. 7 is a partially exploded view of the operating mechanism.
Figure 8:
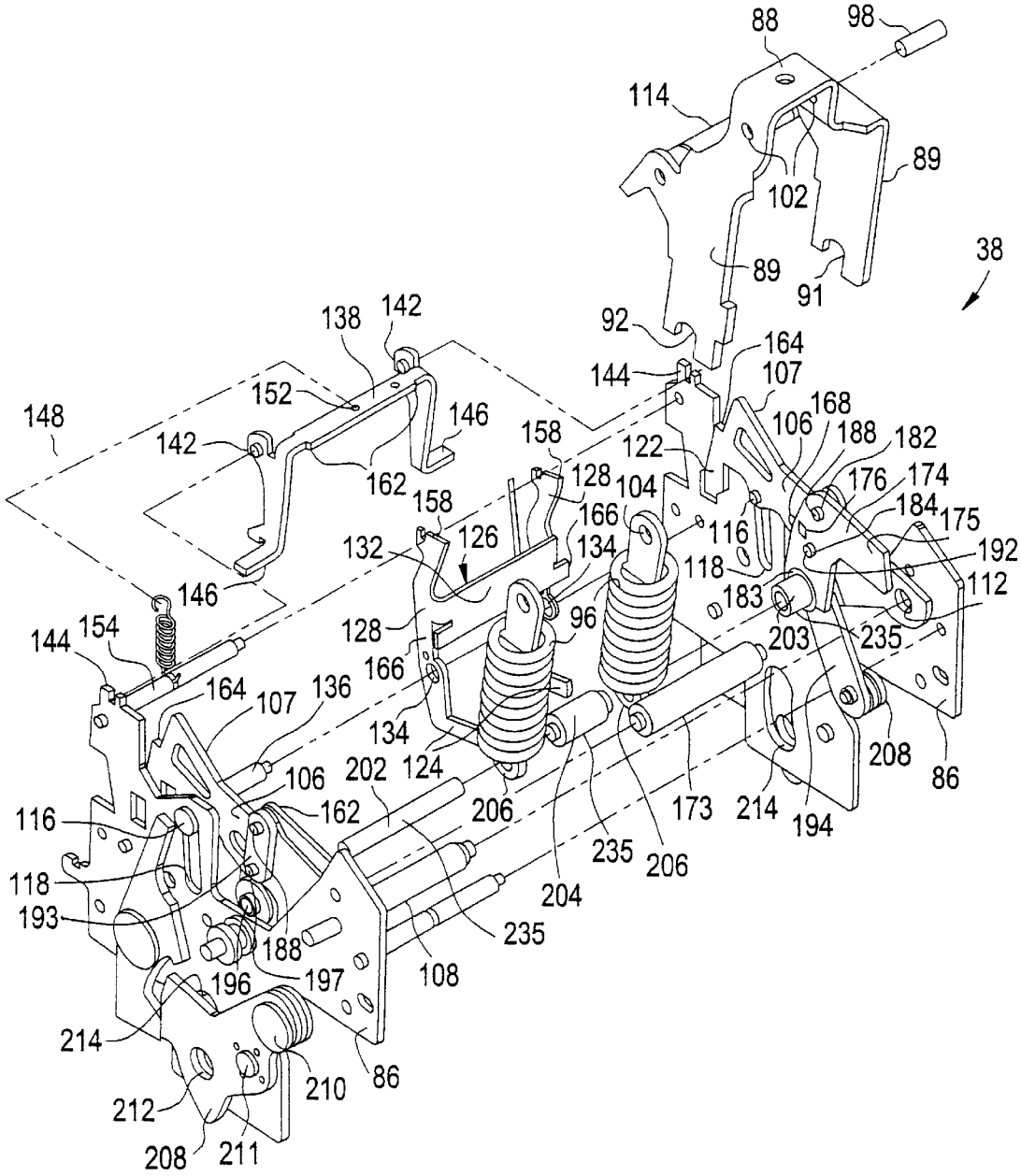
FIG. 8 is another partially exploded view of the operating mechanism.

Referring now to FIGS. 6–8, the components of operating mechanism 38 will now be detailed. As viewed in FIGS. 6–8, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 9:
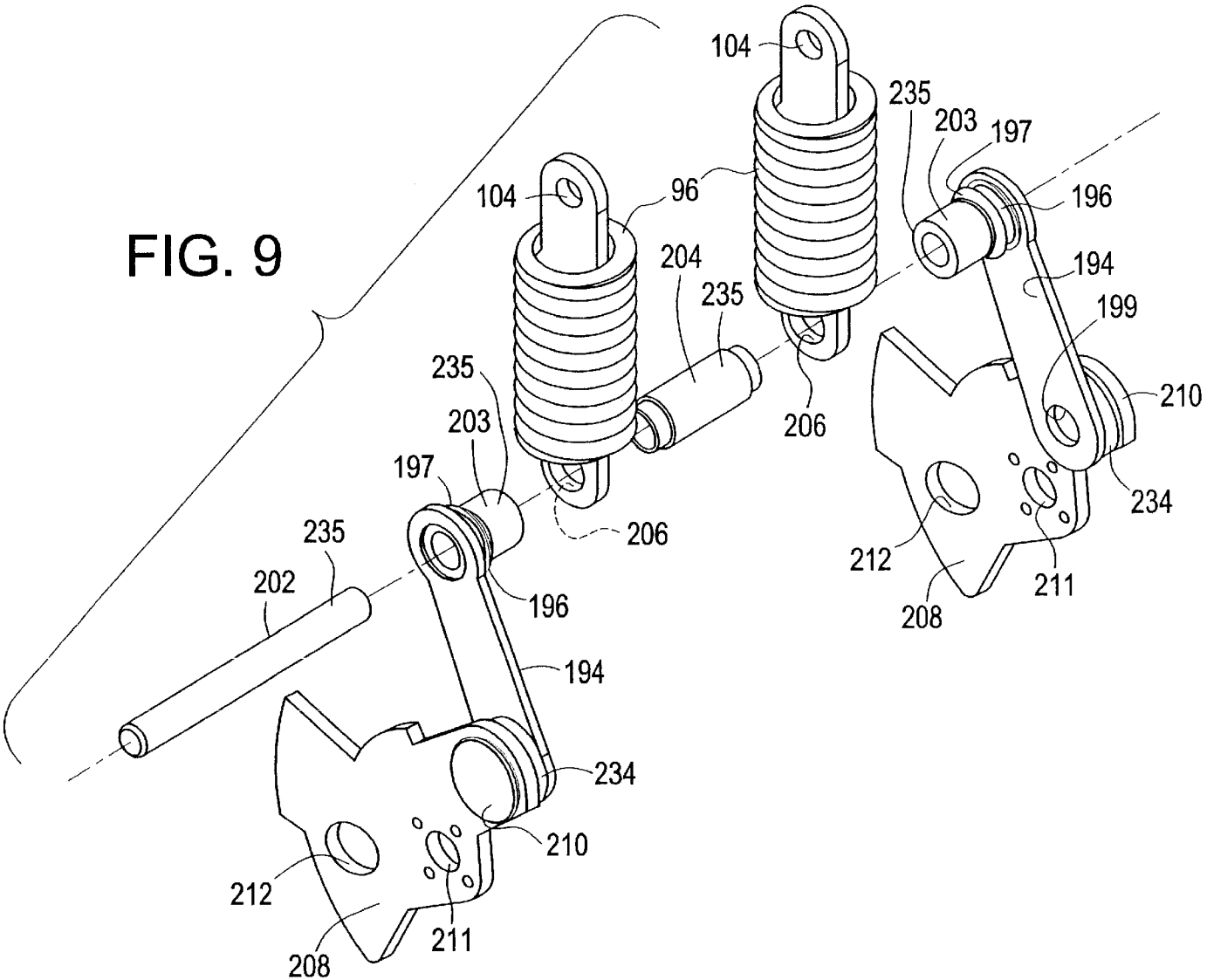
FIG. 9 is an exploded view of a pair of mechanism springs and associated linkage components within the operating mechanism.

Referring to FIG. 9, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 10A:
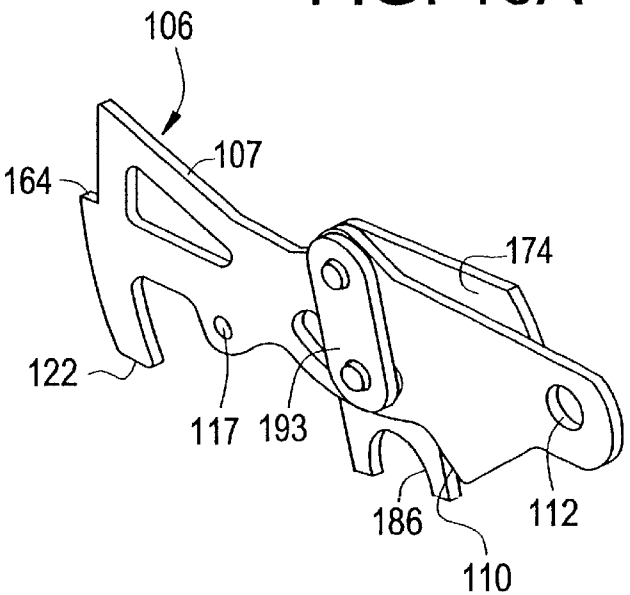
FIG. 10 is an isometric and exploded view of linkage components within the operating mechanism.
Figure 10B:
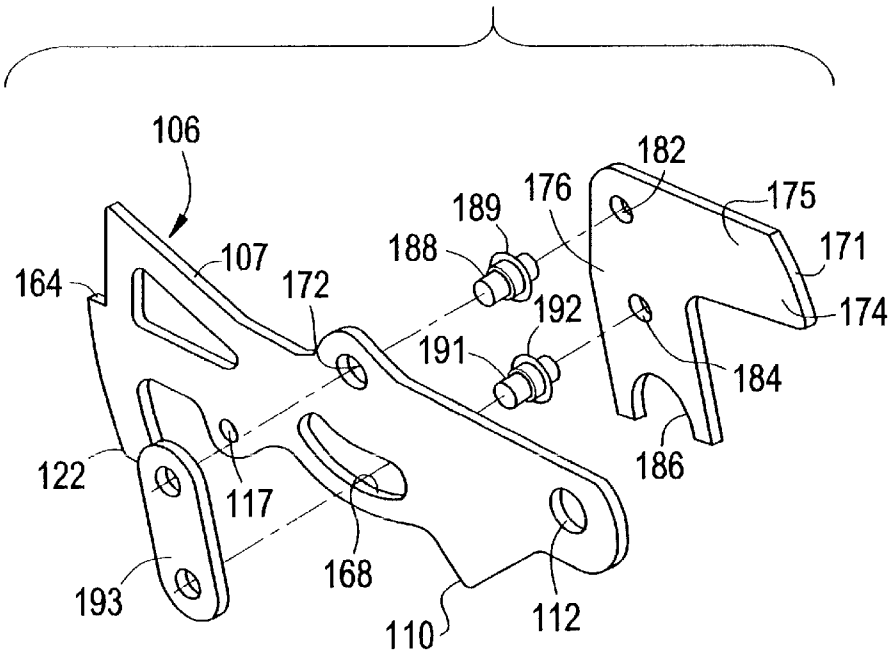

Referring to FIGS. 8 and 10, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. Each cradle 106 also includes a stop surface 110 formed thereon. The movement of each cradle 106 is guided by a rivet 116 disposed through an arcuate slot 118 within each side frame 86. Rivets 116 are disposed within an opening 117 on each the cradle 106. An arcuate slot 168 is positioned intermediate to opening 112 and opening 117 on each cradle 106. An opening 172 is positioned above slot 168.

Referring back to FIGS. 6–8, a primary latch 126 is positioned within side frame 86. Primary latch 126 includes a pair of side portions 128. Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped"position (e.g., as in FIG. 5), described below. Secondary latch 138 includes a set of latch surfaces 162, that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 8 and 10, a set of upper links 174 are connected to cradles 106. Upper links 174 generally have a right angle shape. Legs 175 (in a substantially horizontal configuration and FIGS. 8 and 10) of upper links 174 each have a cam portion 171 that interfaces a roller 173 disposed between frames 86. Legs 176 (in a substantially vertical configuration in FIGS. 8 and 10) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised surfaces 189, 192, respectively. Raised surfaces 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174. any operating mechanism motion, and also to spread force loading between cradles 106 and upper links 174.

Figure 11C:
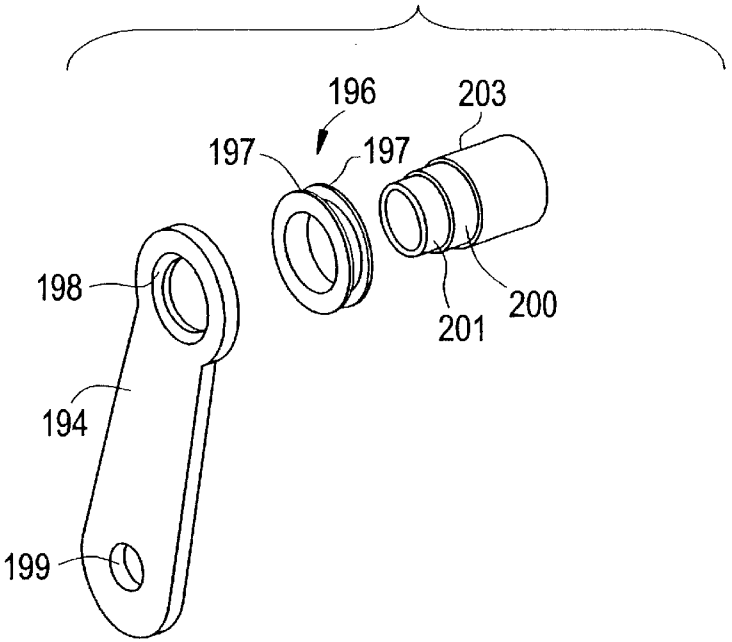
FIG. 11 is a front, isometric, and partially exploded isometric views of a linkage component within the operating mechanism.
Figure 11B:
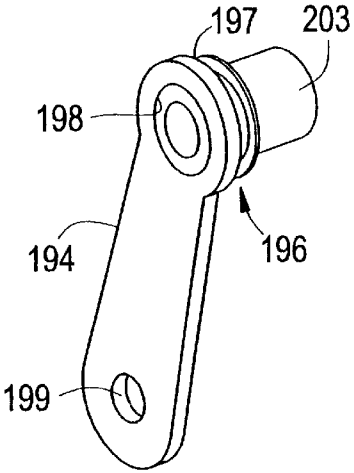
Figure 11A:
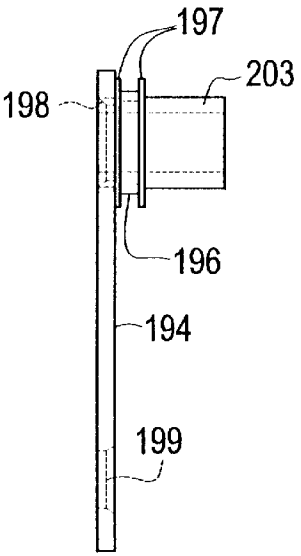

Upper links 174 are each interconnected with a lower link 194. Referring now to FIGS. 8, 10 and 11, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 12C:
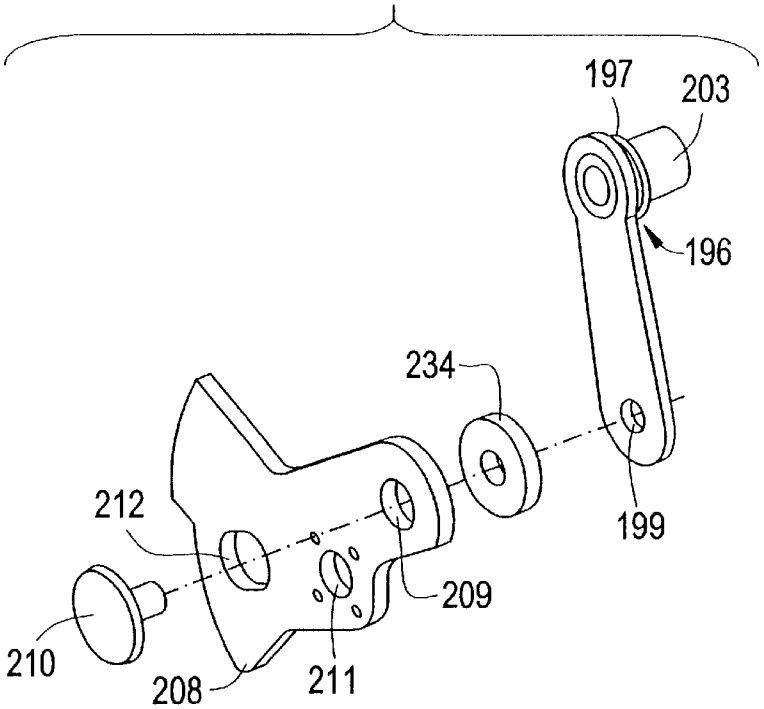
FIG. 12 is a front, isometric, and partially exploded isometric views of linkage components within the operating mechanism.
Figure 12B:
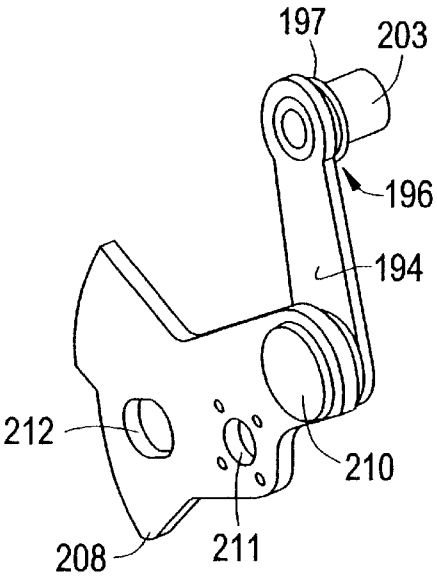
Figure 12A:
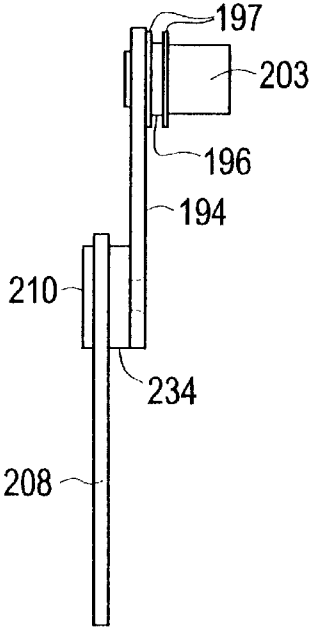

Referring to FIG. 12, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 8).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Referring back to FIGS. 3–5, the movement of operating mechanism 38 relative to rotary contact assembly 56 will be detailed.

Referring to FIG. 3, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force was applied to toggle handle 44 to move it from the "off" position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised portions 189 and 192 (FIG. 10) maintain a suitable space between the surfaces of upper links 174 and cradles 106 to prevent friction therebetween, which would increase the force required to set operating mechanism 38 from "off" to "on". Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194).

Referring now to FIG. 4, a manual closing force was applied to toggle handle 44 to move it from the "off" position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised surfaces 189 and 192 (FIG. 10) maintain a suitable space between the surfaces of upper links 174 and cradles 106 to prevent friction therebetween, which would increase the force required to set operating mechanism 38 from "off" to "on". Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194).

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 are rotated clockwise about pin 108 (i.e., motion guided by rivet 116 in arcuate slot 118). The movement of cradle 106 transmits a force via rivets 188, 191 to upper link 174 (having cam surface 171) . After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

Figure 13:
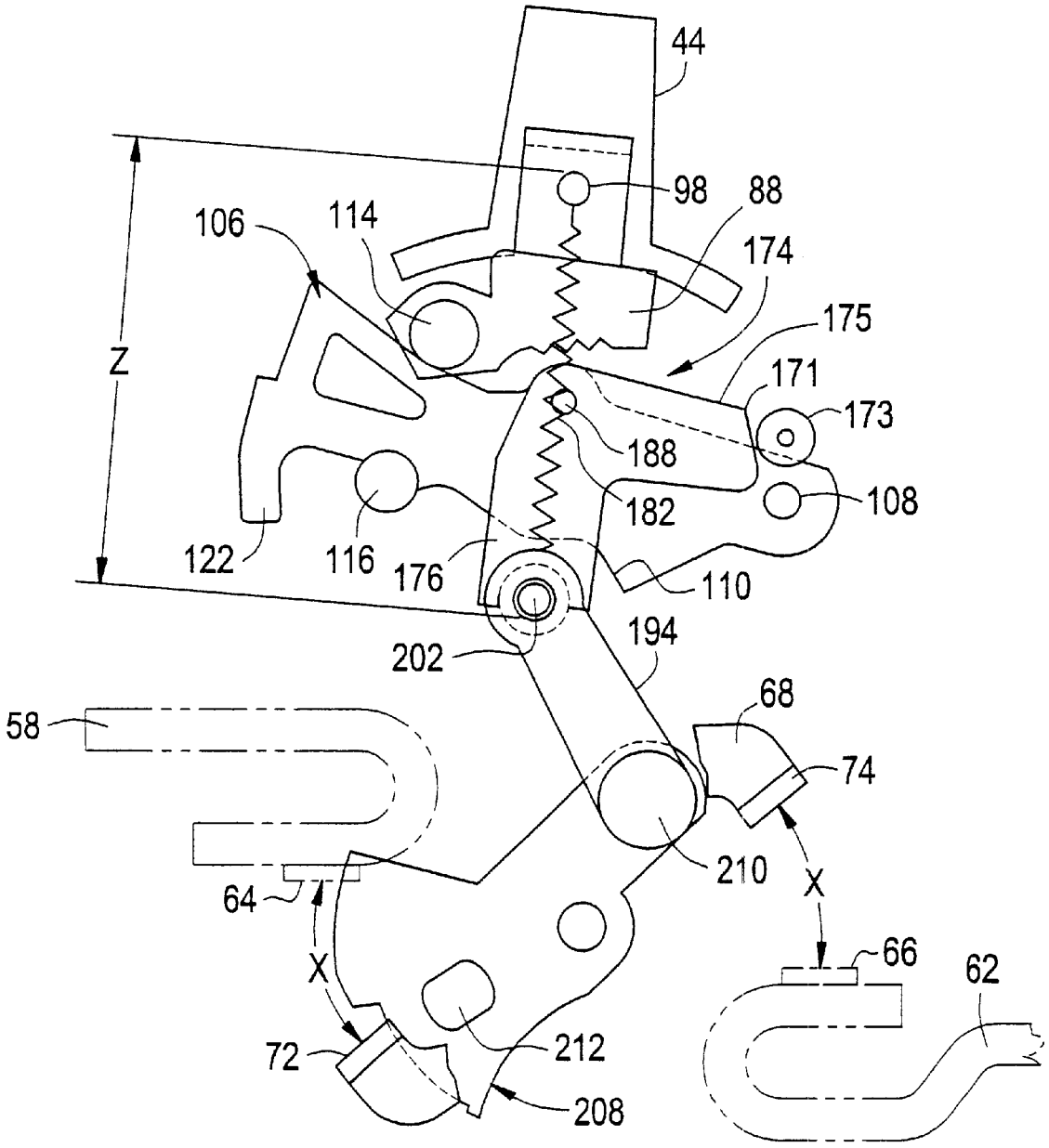
FIG. 13 is a partial sectional view of the rotary contact structure and operating mechanism in the "tripped" position.

Referring to FIG. 13, when the cradles 106 are released, mechanism (operating) springs 96 rotate cradle assemblies 106 in a clockwise direction about its pivot pin 108. Note that after cradles 106 are released and have rotated a predetermined distance, cam surfaces 171 formed on upper links 174 will interact with cam roller 173, which is captivated between side frames 86. A camming action occurs which forces the upper and lower link assemblies 174, 179 away from the stop surfaces 110 on cradles 106. The rotation of cradles 106, in addition to the camming action between cam surfaces 171 and cam roller 173, creates travel of the upper and lower link assemblies 174, 194, which allows the driving bell crank 208 to open the contact arm 68 to a position shown. This rotation of the contact arm 68 establishes an open gap, identified as distance "x", between contacts 64 and 72 and between contacts 68 and 74. The distance between the pin 202 and the spring anchor 98, which secure the mechanism springs 96, is shown as "Z". Distance "Z" determines the effective length of the mechanism springs 96.

The camming action between cam surfaces 171 and cam roller 173 creates greater travel of the upper and lower link assemblies 174, 194 than was previously possible with operating mechanisms of the prior art. The greater travel of the upper and lower link assemblies 174, 194 results in an increase in the open gap dimension "x". Because of this greater amount of travel, the distance between the spring anchor 98 and pin 202 can have a larger "Z" dimension than was previously possible, thus allowing for a larger mechanism spring 96. This is achieved without additional displacement of the cradle assembly 106, and, therefore, without any additional volume needed for the operating mechanism 38. It should also be noted that the upper spring anchor pin 98 is positioned within the center of the toggle handle 44. This also increases the distance "Z", allowing for larger, more powerful mechanism springs 96 than was previously possible without increasing the size of the operating mechanism 38.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical circuit breaker comprising:

a circuit breaker housing;

a first electrical contact fixed within said housing;

a contact arm rotatably secured within said housing, said contact arm having a second electrical contact secured to an end thereof;

an operating mechanism secured within said housing, said operating mechanism including:

a lower link operatively connected to the contact arm;

an upper link including first and second legs extending from a central portion, said first leg pivotally secured to said lower link, said second leg including a cam surface formed thereon;

a roller in intimate contact with said cam surface when said pair of electrical contacts are open, said cam surface being configured to increase a first displacement of said upper link about said central portion during said intimate contact relative to a second displacement of said upper link about said central portion prior to said intimate contact; and wherein said first displacement of said upper link about said central portion during said intimate contact moves said lower link causing said contact arm to rotate and move said second contact away from said first contact, said increase in said first displacement results in a gap between said pair of electrical contacts that is larger than with said second displacement.

2. The circuit breaker operating mechanism of claim 1, further comprising:

a spring attached to said upper link, said spring configured to move said upper link relative to said roller.

3. The circuit breaker of claim 1, further comprising:

a cradle pivotally secured at a first axis to said central portion, said cradle being configured to rotate about a second axis separate from said first axis, wherein rotation of said cradle about said second axis allows movement of said upper link.

4. The circuit breaker of claim 2, further comprising:

an operating handle extending from a slot formed in said housing, said operating handle having a void formed therein, said spring including an end secured to said operating handle within said void.

5. The circuit breaker of claim 3, wherein said intimate contact is a camming action that provides an increase in said gap between said pair of electrical contacts without increasing rotational displacement of said cradle.

* * * * *